US005422780A

United States Patent [19]

Lignar

[11] Patent Number: 5,422,780

[45] Date of Patent: Jun. 6, 1995

[54] SOLENOID DRIVE CIRCUIT

[75] Inventor: Kenneth A. Lignar, Glastonbury, Conn.

[73] Assignee: The Lee Company, Westbrook, Conn.

[21] Appl. No.: 313,542

[22] Filed: Sep. 27, 1994

Related U.S. Application Data

[63] Continuation-in-part of Ser. No. 994,937, Dec. 22, 1992, abandoned.

[51] Int. Cl.[6] ..... H01H 47/04; H01H 47/32; H01H 47/18

[52] U.S. Cl. ..... 361/154; 361/195; 323/282

[58] Field of Search ..... 361/152–156, 361/194–202; 323/282, 288

[56] References Cited

U.S. PATENT DOCUMENTS

| | | | |
|---|---|---|---|
| 3,116,441 | 12/1963 | Gieffers | 361/154 |
| 3,469,152 | 9/1969 | Bosman | 361/196 |
| 4,065,096 | 12/1977 | Frantz et al. | 361/152 X |
| 4,227,231 | 10/1980 | Hansen et al. | 361/154 |
| 4,502,090 | 2/1985 | Sloan | 361/153 |
| 5,168,418 | 12/1992 | Hurley et al. | 361/155 |
| 5,245,501 | 9/1993 | Locher et al. | 361/154 |
| 5,317,475 | 5/1994 | Siepmann | 361/154 |

*Primary Examiner*—A. D. Pellinen
*Assistant Examiner*—Fritz M. Fleming
*Attorney, Agent, or Firm*—Philip J. Lee

[57] ABSTRACT

A solenoid drive circuit comprises a timing circuit which activates a voltage control circuit causing a voltage regulator to reduce the voltage output by the driver circuit from a high initial level to a lower holding level sufficient for the solenoid to remain energized. The timing circuit comprises a resistor and capacitor in parallel and the duration of the initial higher voltage output is inversely proportional to the input voltage level. The timing circuit activates a transister in the control circuit changing the equivalent resistance between the adjustment terminal of the voltage regulator and ground thereby causing a reduction in the output voltage.

19 Claims, 5 Drawing Sheets

PRIOR ART

OUTPUT

INPUT

OUTPUT

INPUT

SOLENOID DRIVE CIRCUIT

This is a continuation-in-part of application Ser. No. 07/994,937 filed on Dec. 22, 1994, now abandoned.

BACKGROUND OF THE INVENTION

A. Field of Invention

The present invention relates generally to driver circuits and more particularly to a new and improved circuit used to drive a solenoid coil.

B. Description of Related art

When operating a solenoid coil, for example as a valve actuator, power consumption can be a concern, particularly when high power consumption causes coil heating. When multiple solenoid actuated valves are grouped and required to have high speed operation capability, it is desirable to reduce power consumption while not reducing the voltage necessary for high speed coil excitation. Circuitry has been designed to cause the voltage directed to the coil to include an initial high voltage "spike" followed by a lower "hold" voltage. Such circuitry is designed to initiate rapid excitation of the solenoid with the voltage spike and maintain the excitation of the solenoid with the lower voltage, hold portion of the signal. In this way, the relatively high voltage necessary to quickly and efficiently operate a solenoid coil is not continued during the portion of the operation cycle when high voltage is not required to maintain the solenoid in operation.

FIG. 1 represents a prior art solenoid coil drive circuit that utilizes a spike and hold method of operating a solenoid. The spike and hold method activates the solenoid with a high voltage spike (usually two or three times the rated voltage of the coil) for only long enough to switch the position of the solenoid armature. The input voltage is reduced to a holding voltage (usually about one half the rated coil voltage) for the remainder of the on cycle. By using a lower voltage to hold the solenoid armature in the "on" position, less power is used when operating the solenoid. The wave forms in FIGS. 2*a* and 2*b* represent a common input signal and the resulting voltage across the solenoid coil generated by the conventional spike and hold circuit such as diagramed in FIG. 1. A square wave signal is applied to the control signal input terminals. When the control signal is high, a transistor (Q4 in FIG. 1) is turned on which allows current to flow through the solenoid coil. Another transistor (Q1 in FIG. 1) is coupled to the control signal input terminal through a capacitor (C2 in FIG. 1) and a resistor (R2 in FIG. 1) and is momentarily turned on at the rising edge of the control signal. This initiates a timer circuit to output a pulse of a duration that is determined by the combination of a resistor (R1 in FIG. 1) and a capacitor (C1 in FIG. 1). The output pulse from the timer circuit turns on two other transistors (Q2 and Q3 in FIG. 1) which allow voltage (V1) to be applied to the coil. Diode D1 isolates voltage V2 from V1 when V1 is applied to the coil. When the timer circuit output pulse terminates, transistors Q2 and Q3 turn off. This isolates voltage V1 from the solenoid coil and allows a second voltage (V2) to be applied to the coil. The voltage V2 represents the lower holding voltage and will continue to hold the solenoid armature in the "on" position until the control voltage is removed from the control signal terminals. This turns off transistor Q4 which prevents current from flowing though the coil.

The circuit in FIG. 1 requires at least two different voltage levels (V1, V2, and possible a third level for the timer) as well as a control signal input. Extensive circuitry is necessary to insure correct timing sequences between the timer and the transistor as well as to isolate the different voltage levels during activation of the solenoid coil.

SUMMARY OF THE INVENTION

The present invention is a drive-circuit specifically designed for the operation of a solenoid. The drive circuit consists of a timing circuit, a variable voltage regulator, and a voltage control circuit. Timing circuit comprises a first resistor and capacitor connected in parallel to each other with a second resistor serially connected to the resistor-capacitor circuit between said resistor-capacitor circuit and the input voltage source such that after charging the first capacitor, the first and second resistors split the voltage and a connection is made to the voltage control circuit between the resistor-capacitor circuit and the second resistor. The variable voltage regulator has an input-terminal, an output-terminal, and an adjustment terminal and may be one of several commercially available regulators. The input terminal of the voltage regulator and the second resistor are connected to a voltage source from which to receive a control signal as an essentially rectangular wave or a voltage level that is effective for the desired operation and rapid excitation of the device to be driven. The variable voltage regulator comprises means for adjusting the voltage at the output terminal in response to variations in the voltage at the adjustment terminal. The voltage control circuit is a means for changing the voltage at the voltage regulator adjustment terminal in response to activation by the timing circuit. Specifically, the voltage control circuit comprises a third resistor connected to the output terminal of the voltage regulator and serially connected to two additional resistors that are parallel to each other. The adjustment terminal is connected to the voltage control circuit between the third resistor and the parallel pair of fourth and fifth resistors. Between the fourth resistor and ground is interposed a field effect transistor the gate of which is connected to the timing circuit between the second resistor and the resistor-capacitor pair. The source of the field effect transistor is grounded and the drain of the field effect transistor is connected to the fourth resistor. In operation, while the capacitor is charging, the field effect transistor is open, taking out the fourth resistor, and accordingly the voltage at the adjustment terminal of the voltage regulator is controlled by the voltage derived from the third resistor and the fifth resistor. On charging of the first capacitor in the timing circuit, the voltage at the base of the field effect transistor reaches a level sufficient to close the transistor. As the transistor closes, the voltage at the adjustment terminal of the voltage regulator is changed to the voltage derived from the third resistor and the equivalent resistance of the now parallel fourth and fifth resistors. The effect of the change to the equivalent resistance is to reduce the voltage at the adjustment terminal thereby causing the voltage regulator to reduce the voltage at its output terminal to which the device to be driven is connected. A second capacitor may be also connected between the voltage source and ground and a diode is connected parallel to the solenoid coil.

Since the voltage of the control signal is in inverse proportion to the charging time of the first capacitor, the change in duration of the "spike" portion of the output voltage approximates the wave form needed for efficient operation of the solenoid coil (i.e. shorter duration for higher voltage). The impedance of the fourth and fifth resistors may be varied to control the amount of reduction of the output voltage after activation of the field effect transistor by the timing circuit thus adjusting the "holding" voltage level.

The circuit presented in FIG. 3 offers several advantages over the prior art as exemplified by the circuit in FIG. 1. First, the present circuit has the advantage of operating solely from a single input control signal and no other additional voltage inputs are necessary. Second, the resistor-capacitor timer circuit of the present invention also has the advantage of being input voltage dependant in that the duration of the spike voltage is inversely proportional to the input voltage. Thus if higher voltages are applied the duration of the spike voltage decreases. Since solenoid coils respond faster as higher voltages are applied to their coils, only a shorter spike pulse duration is required at higher input voltages. By shortening the spike duration for higher input voltages, power consumption is minimized. The holding voltage which is applied to maintain the solenoid in operation after the spike voltage initiates the movement of the solenoid armature is constant and unaffected by the input voltage level. These features offer the flexibility of using the circuit over a wide range of input voltages. The driver circuit of the present invention requires fewer components being thus more economical to manufacture and maintain. The driver circuit of the present invention consumes power only when the solenoid is being energized while, the prior art circuit in FIG. 1 has power continually applied to the timer circuit which consumes power whether the solenoid is energized or not.

The principal aim of the present invention is to provide a new and improved drive circuit for the efficient operation of a solenoid coil.

Another and further object and aim of the present invention is to provide a new and improved drive circuit for the operation of a solenoid coil with a rapid activation time and relatively low power consumption and coil heat generation.

Other objects and advantages of the invention will become apparent from the Description of the Preferred Embodiments and the Drawings and will be in part pointed out in more detail hereinafter.

The invention consists in the features of construction, combination of elements and arrangement of parts exemplified in the construction hereinafter described and the scope of the invention will be indicated in the appended claims.

BRIEF DESCRIPTION OF THE DRAWINGS

FIG. 2(*b*) is a graph depicting the wave form of voltage produced by the prior art circuit depicted in FIG. 1.

FIG.4(*b*) is a graph depicting the wave form of voltage produced by the circuit depicted in FIG. 3 in response to the signal depicted in FIG. 4(*a*).

DESCRIPTION OF THE PREFERRED EMBODIMENT(S)

Figure 1:
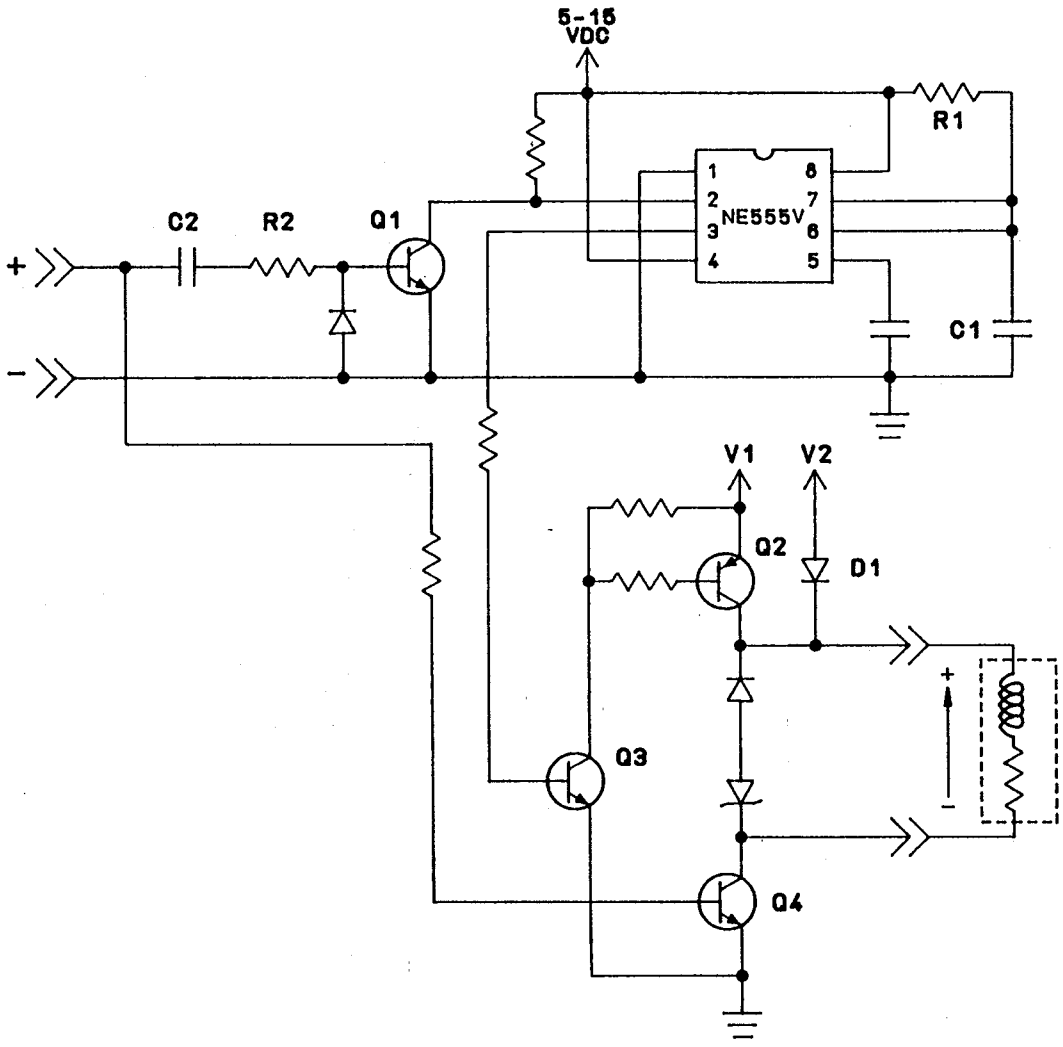
FIG. 1 is a schematic diagram of a conventional spike and hold circuit according to the prior art.
Figure 2B:
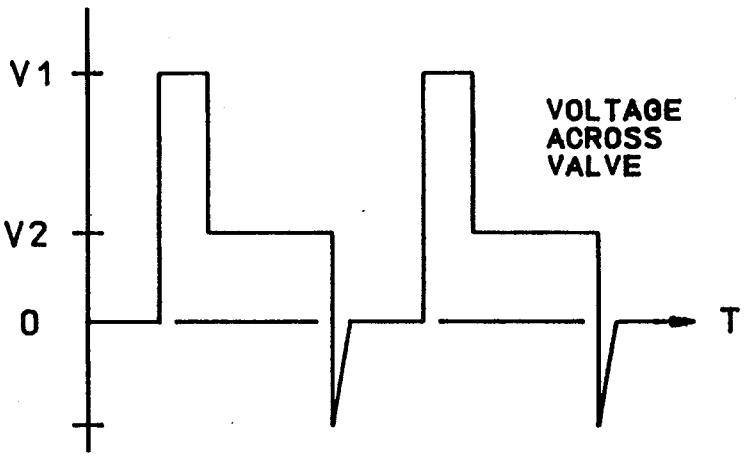
FIG. 2B PRIOR ART
FIG. 2(*a*) is a graph showing the wave form of the control signal used to activate the prior art circuit depicted in FIG. 1.
Figure 2A:
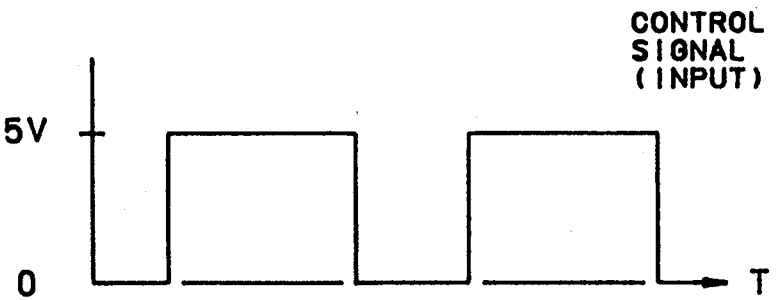
FIG. 2A PRIOR ART
Figure 3:
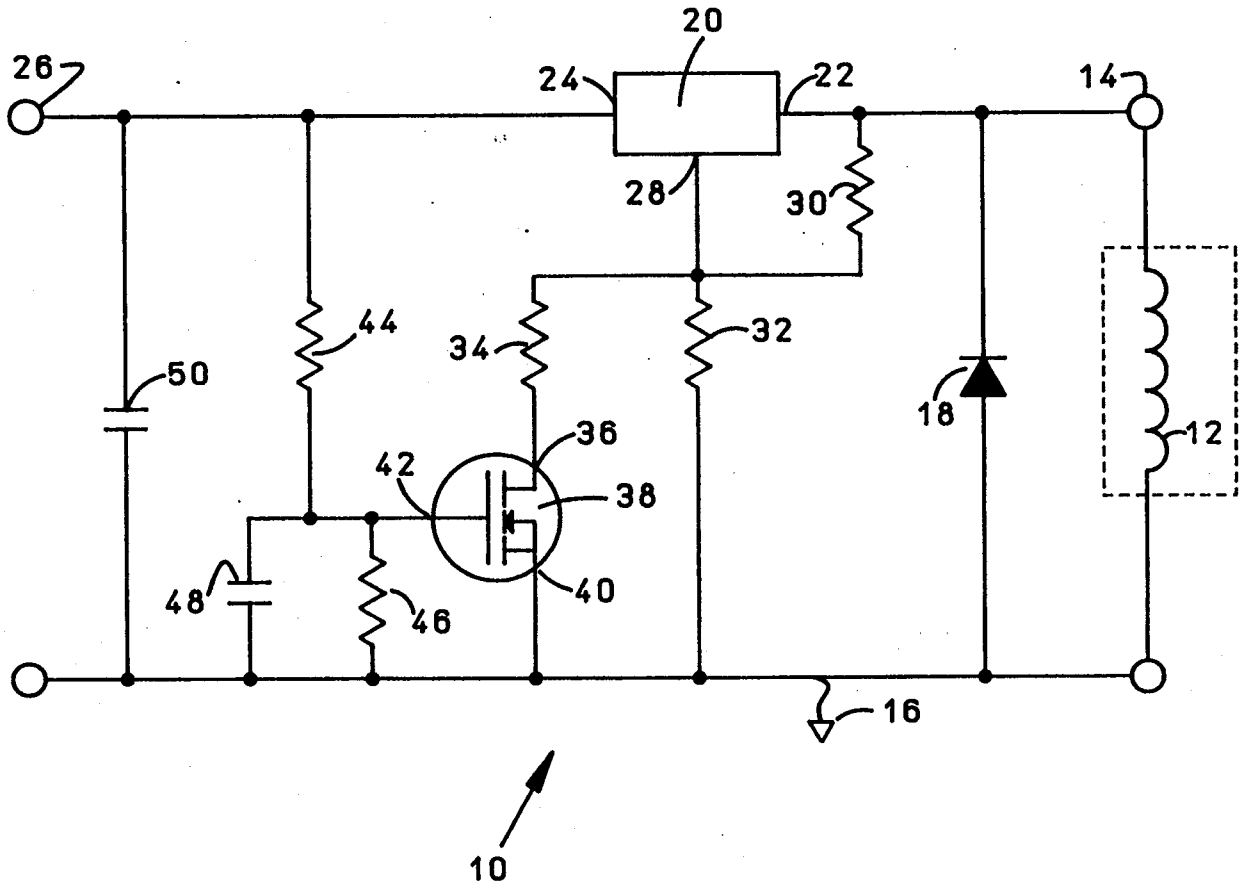
FIG. 3 is a schematic diagram of a drive-circuit in accordance with the present invention.

With reference to the drawings wherein like numerals represent like parts throughout the Figures, a solenoid driver circuit in accordance with the present invention is generally designated by numeral 10 in FIG. 3. A first end of the solenoid coil 12 is connected to a output voltage terminal 14 and the second end is connected to a ground terminal 16. A switching diode 18 is connected in parallel with the solenoid coil 12. A voltage regulator 20 has an output pin 22 connected to the output voltage terminal 14, an input pin 24 connected to the input voltage terminal 26, and an adjustment pin 28 connected to resistors 30, 32 and 34. Resistor 30 has its first end connected to the output pin 22 of the voltage regulator 20 and the second end of resistor 30 is connected to the adjustment pin 28 of said regulator 20. Resistor 32 has its first end connected to the adjustment pin of said voltage regulator 20 and its second end connected to the ground terminal 16. The first end of resistor 34 is connected to the adjustment pin 28 of said voltage regulator 20 and the second end of resistor 34 is connected to the drain terminal 36 of an N-channel field effect transistor 38.

The source terminal 40 of the N-channel field effect transistor 38 is connected to the ground terminal 16. The gate terminal 42 of the N-channel field effect transistor 38 is connected to a timing circuit comprising of two resistors 44 and 46 and a capacitor 48. The first end of resistor 44 is connected to the input voltage terminal 26 and the second end of resistor 44 is connected to the gate terminal 42 of the N-channel field effect transistor 38. The first end of resistor 46 is connected to the gate terminal 42 of the N-channel field effect transistor 38 and the second end of resistor 46 is connected to the ground terminal 16. Capacitor 48 is connected in parallel with resistor 46. The first end of a second capacitor 50 is connected to the input voltage terminal 26 and the second end of capacitor 50 is connected to the ground terminal 16.

Figure 4B:
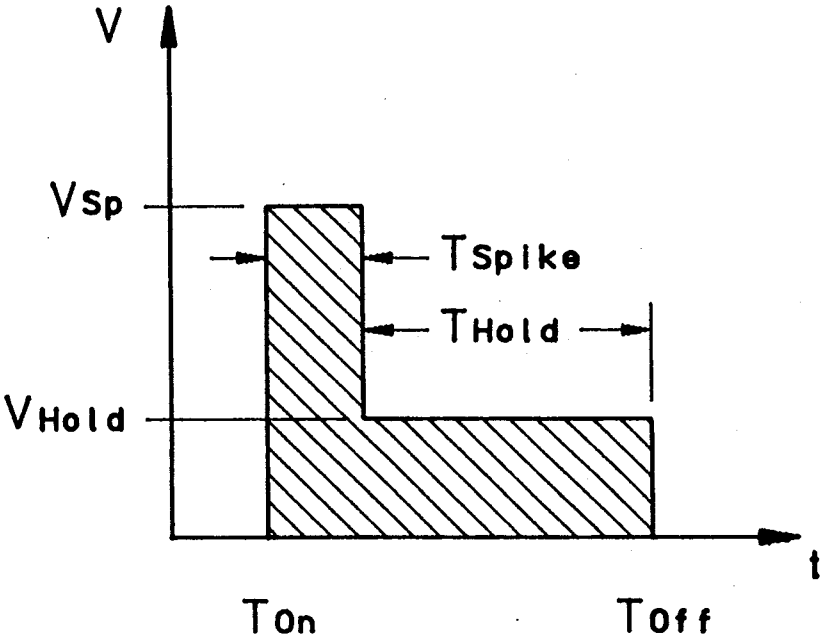
FIG. 4(*a*) is a graph depicting the wave form of the voltage signal into the circuit depicted in FIG. 3.
Figure 4A:
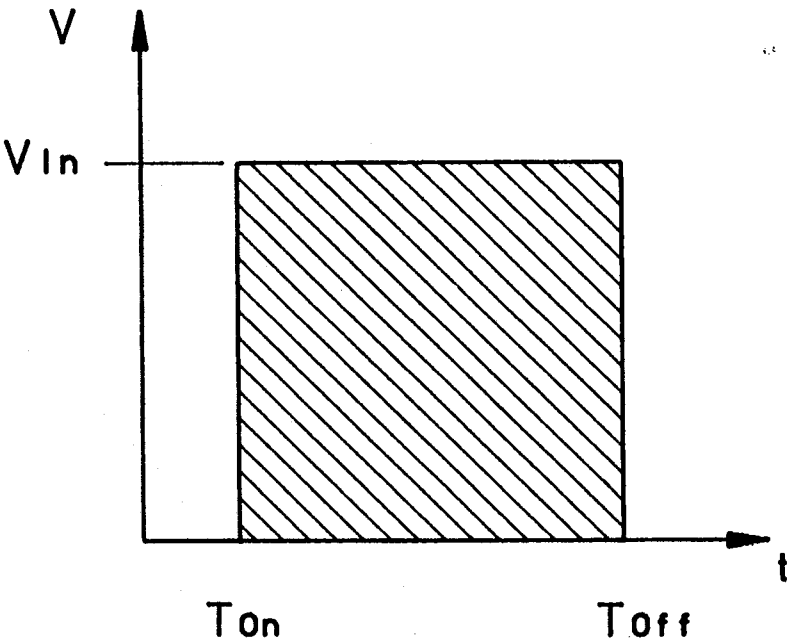

The wave forms shown in FIG. 4 represent the input voltage to the drive circuit 10 and the resulting voltage at the output terminal of the circuit 10 which is the same as the voltage across the solenoid coil 12. Applying a voltage of a sufficient level to energize the solenoid 12 to the input voltage terminal 26 causes an initial output voltage to be generated at the output terminal 14 whose level is determined by the resistors 30 and 32. These resistors are of a predetermined value such that the generated output voltage is approximately equal to the input voltage and is sufficient to activate the solenoid. Resistor 34 is isolated from the voltage regulator 20 while the N-channel field effect transistor 38 is in the off state. Applying the voltage to input voltage terminal 26 starts charging the capacitor 48 at a rate determined by the values of Resistors 44 and 46 and timing circuit capacitor 48. When the voltage across timing circuit capacitor 48, which is also the voltage at the gate terminal 42 of the N-channel field effect transistor 38, reaches a predetermined level the N-channel field effect transistor 38 changes to the on state. This rate of charging timing circuit capacitor 48 determines the duration of the higher voltage supplied to the solenoid coil 12 such that the spike is of sufficient duration to activate the solenoid coil 12. When the N-channel field effect transistor 38 turns on, resistor 34 is now in parallel with resistor 32 changing the equivalent resistance connected between the adjustment pin 28 of the voltage regulator 20 and the ground terminal 16. This causes the output voltage to change to a new level determined by the equivalent resistor. The value of resistor 34 is chosen such that the equivalent resistance of resistor 34 in parallel with resistor 32 causes the voltage at the output terminal 24, and hence across the solenoid coil 12, to be much less than the input voltage but sufficient to keep the solenoid coil 12 energized. The output voltage will remain at this 'holding' level until the voltage is removed from the input terminal 26. Removing the input voltage causes the output voltage to drop to zero deenergizing the solenoid coil 12 and allows the voltage at the N-channel field effect transistor gate 42 to discharge to zero volts which returns the N-channel field effect transistor 38 back to the off-state. After a predetermined time the capacitor 48 is fully discharged and the circuit is ready to be energized again. This discharge time is dependent on the component values of the timing circuit and the input voltage.

As may be expected, there are many variations of values possible for the individual components of drive circuit 10 with corresponding variations in performance. As an exemplar of the performance of the drive circuit 10, FIG. 4(*a*) and 4(*b*) depict a typical input voltage and the resulting output voltage produced by a particular configuration of the preferred embodiment of drive circuit 10. Specifically, the output voltage shown in FIG. 4(*b*) is produced by the drive circuit 10 wherein the voltage regulator 38 is a three terminal adjustable regulator supplied by National Semiconductor Corporation under part number LM317L, which according to the purveyor's specifications, will produce an output voltage according to the following formula:

$$V_{out} = 1.25\text{V}\left(1 + \frac{R_2}{R_1}\right) + I_{adj}(R_2)$$

wherein $R_1$ corresponds to Resistor 30 of the drive circuit 10 and $R_2$ corresponds to the resistance provided by Resistor 32 when field effect transistor 38 is turned off and by the equivalent resistance provided by Resistors 32 and 34 when the field effect transistor 38 is turned on, and $I_{adj}$ corresponds to the current at the regulator adjustment pin 28, the $V_{out}$ represents the output voltage at the output pin 22 of regulator 20 and V on the right side of the equation signifies that the units of measure are volts and does not constitute a variable. The specific output voltage depicted in FIG. 4(*b*) is produced by drive circuit 10 wherein the following components were of the performance characteristics and values as described below:

| COMPONENT | VALUE |
|---|---|
| Resistor 30 | 240 Ohms |
| Resistor 32 | 5.1 Kilo Ohms |
| Resistor 34 | 820 Ohms |
| Resistor 44 | 1.3 Mega Ohms |
| Resistor 46 | 150 Kilo Ohms |
| Capacitor 48 | 0.1 micro Farads |

-continued

| COMPONENT | VALUE |
|---|---|
| Capacitor 50 | 0.1 micro Farads |

Figure 5B:
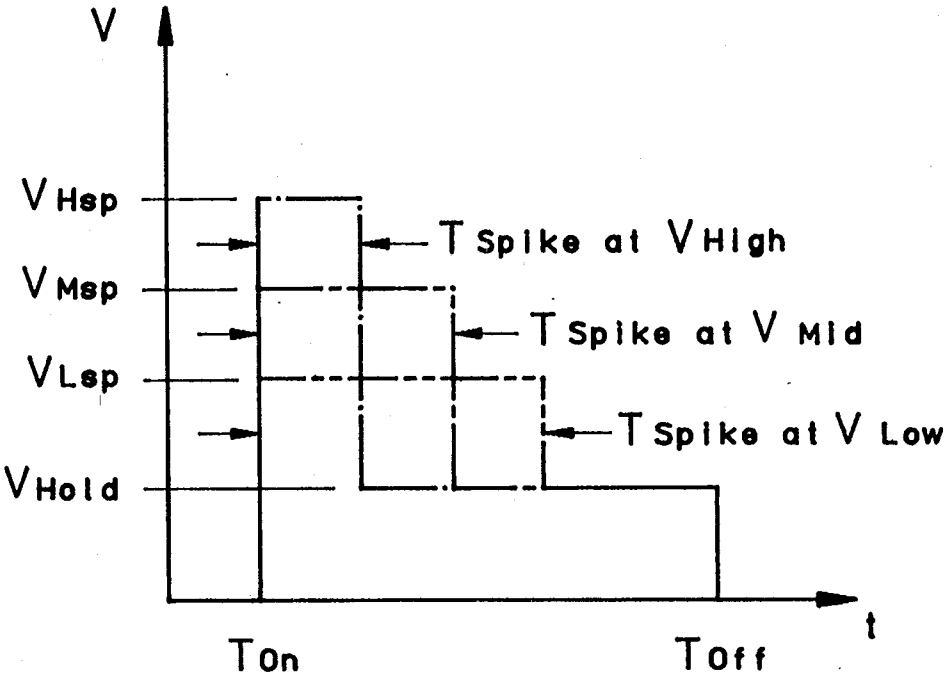
FIG. 5A is a graph showing three different signals and FIG. 5B is a graph showing the voltage wave forms produced by the circuit depicted in FIG. 3 in response to said signals superimposed upon each other.
Figure 5A:
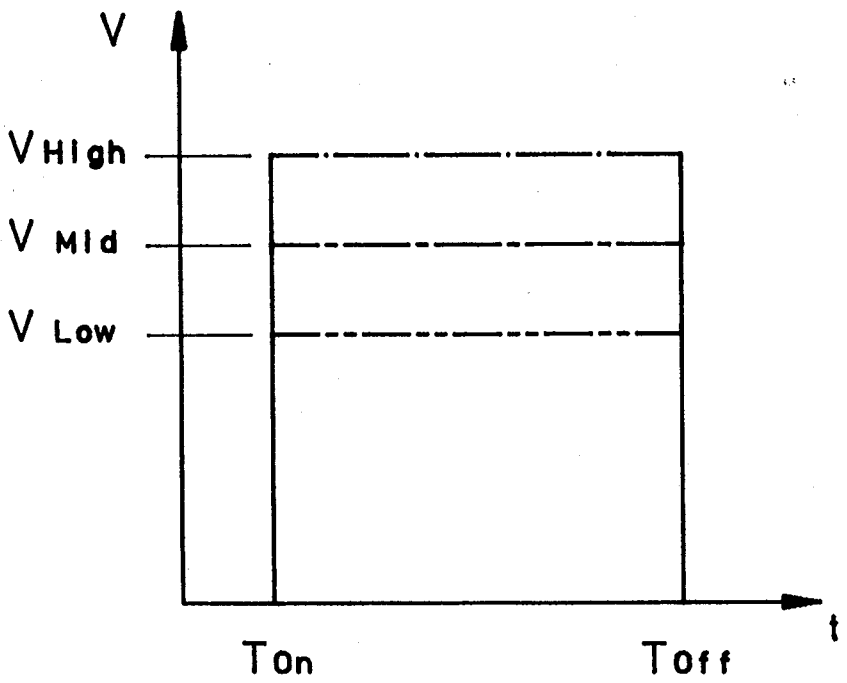

The drive circuit 10 with the specific values set forth above, by way of further illustration of its performance, produces the variety of wave forms depicted in FIG. 5 in response to a variety of input voltages as shown therein. As such, FIG. 5 exemplifies and graphically shows the inverse relationship of the input voltage level to the duration of high voltage or "spike" portion of the output voltage. As such, the graphs shown in FIGS. 5A and 5B, are idealized representations of the relationship between input voltage and the duration of the spike portion of the output voltage, showing the changes in voltage V on the vertical axis, over time t on the horizontal axis, from the input source in FIG. 5A and at the output pin 22 of regulator 20 in FIG. 5B and are intended solely for the purpose of illustration and not as an expression or representation of particular test data. Typically, with the particular component values recited herein, the duration of the spike portion of the output, shown as "$T_{spike}$ in FIG. 5B would be expected to be on the order of 50 milliseconds, given an input voltage of 15 volts. The change in duration of the "spike" portion of the graph represents the change in the charging time for the capacitor 48, which delays the turning on of the transistor 38. Accordingly, the vertical edge of each graph in FIG. 5B, at the termination of the output voltages, $V_{Hsp}$, $V_{Msp}$, and $V_{Lsp}$ as T spike, the end of the "Spike", constitutes the time when capacitor 48 has become fully charged causing the input voltage as divided by resistors 44 and 46 to turn on transistor 38, thereby changing the equivalent resistance of resistors 34 and 32, causing the regulator 20 to drop the output voltage according to the equation discussed above. The specific duration of the "spike" portion of the output voltage can be modified by changing the values of resistors 44 and 46 and capacitor 48. The output voltage level during the "hold" portion of the output signal may be varied by changing the values of resistors 30, 32, and 34 and is not affected by the input voltage level.

Although the preferred embodiment for the present invention described above identifies transistor 38 as an N-channel field effect transistor, the circuit of the present invention will perform if other types of transistors or other electronic switching means, specifically including a bipolar junction transistor, are substituted for the field effect transistor as transistor 38. Such substitution would involve connecting the base electrode of the bipolar junction transistor in the same manner as the gate terminal 42 of transistor 38 is connected in the foregoing description. Further, appropriate connections of the other electrodes of a transistor, such as the emitter and collector electrodes of a n-p-n bipolar junction transistor would have to be made in the same manner as the source terminal 40 and drain terminal 36 of the described transistor 38.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A drive circuit for modifying the voltage from an input voltage source and supplying the modified voltage to a device, the drive circuit comprising:

A. a timing circuit;

B. a variable voltage regulator comprising an input terminal connected to the input voltage source, an output terminal connected to the device to be driven, and an adjustment terminal; and C. a control circuit activated by the timing circuit to vary the operation of the voltage regulator, the control circuit comprising a first resistor in series with a variable impedance resistor means, the variable impedance resistor means comprising a second resistor in parallel with a third resistor which is connected in series with a transistor connected between the third resistor and ground and having a control electrode connected to the timing circuit, the adjustment terminal of the voltage regulator being connected between the first resistor and the variable impedance resistor means.

2. A drive circuit according to claim 1, wherein the timing circuit comprises a fourth resistor and a first capacitor connected in parallel.

3. A drive circuit according to claim 2, wherein the timing circuit further comprises a fifth resistor serially connected between the input voltage and the fourth resistor and first capacitor.

4. A drive circuit according to claim 3, wherein the control circuit is connected between the output terminal of the voltage regulator and ground.

5. A drive circuit according to claim 4, wherein the control electrode of the transistor of the voltage control circuit is connected to the timing circuit between the fifth and fourth resistors.

6. A drive circuit according to claim 5, further comprising a second capacitor connected between the input voltage source and ground, and wherein the device to be driven is connected to the output terminal of the voltage regulator.

7. A drive circuit according to claim 6 wherein the device to be driven comprises a solenoid coil with a diode connected in parallel.

8. A drive circuit for modifying the voltage from an input voltage source and supplying the modified voltage to a device, the drive circuit comprising:

A. a timing circuit;

B. a variable voltage regulator comprising an input terminal connected to the input voltage source, an output terminal connected to the device to be driven, and an adjustment terminal; and C. a voltage control circuit activated by the timing circuit to vary the operation of the voltage regulator, the control circuit comprising a first resistor in series with a variable impedance resistor means, the variable impedance resistor means comprising a second resistor in parallel with a third resistor which is connected in series with a field effect transistor having a source connected to ground and a drain connected to the third resistor and having a gate connected to the timing circuit, the adjustment terminal of the voltage regulator being connected between the first resistor and the variable impedance resistor means.

9. A drive circuit according to claim 8, wherein the timing circuit comprises a fourth resistor and a first capacitor connected in parallel.

10. A drive circuit according to claim 9, wherein the timing circuit further comprises a fifth resistor serially connected between the input voltage and the fourth resistor and first capacitor.

11. A drive circuit according to claim 10, wherein the first resistor is connected to the output terminal of the voltage regulator.

12. A drive circuit according to claim 11, wherein the gate of the field-effect transistor is connected between the fourth and fifth resistors of the timing circuit.

13. A drive circuit according to claim 12, further comprising a second capacitor between the input voltage source and ground in parallel with the timing circuit.

14. A drive circuit according to claim 13 wherein the device to be driven comprises a solenoid coil with a diode connected in parallel.

15. A drive circuit for operating a solenoid coil from an input voltage source providing an input voltage, comprising:

A. a timing circuit comprising a first resistor and a first capacitor connected in parallel and a second resistor serially connected between the input voltage source and the first resistor and capacitor to divide the input voltage;

B. a variable voltage regulator comprising an input terminal connected to the input voltage source, an output terminal connected to the solenoid coil, and an adjustment terminal; and C. a control circuit connected to the adjustment terminal of the voltage regulator, the control circuit comprising a variable impedance resistor means comprising a third resistor in parallel with a fourth resistor which is connected in series with a field-effect transistor having a source connected to ground and a drain connected to the third resistor and a gate connected to the timing circuit between the first and second resistors of the timing circuit, whereby the voltage control circuit is activated by the timing circuit.

16. A drive circuit according to claim 15, wherein the control circuit further comprises a fifth resistor connected between the voltage regulator output terminal and the voltage regulator adjustment terminal.

17. A drive circuit according to claim 16, wherein the variable impedance resistor means is connected to the voltage regulator adjustment terminal.

18. A drive circuit according to claim 17, further comprising a second capacitor between the voltage source and ground being connected in parallel with the timing circuit.

19. A drive circuit according to claim 18 further comprises a diode connected in parallel with the solenoid coil.

* * * * *